US006073677A

United States Patent [19]

Bäckerud et al.

[11] Patent Number: 6,073,677

[45] Date of Patent: Jun. 13, 2000

[54] METHOD FOR OPTIMIZATION OF THE GRAIN REFINEMENT OF ALUMINUM ALLOYS

[75] Inventors: Lennart Bäckerud; Mats Johnsson, both of Stockholm, Sweden; Geoffrey Sigworth, Johnstown, Pa.

[73] Assignee: Opticast AB, Stockholm, Sweden

[21] Appl. No.: 09/043,446

[22] PCT Filed: Nov. 21, 1996

[86] PCT No.: PCT/SE96/01517

§ 371 Date: Aug. 4, 1998

§ 102(e) Date: Aug. 4, 1998

[87] PCT Pub. No.: WO97/19200

PCT Pub. Date: May 29, 1997

[30] Foreign Application Priority Data

Nov. 21, 1995 [SE] Sweden ..... 9504146
Jun. 14, 1996 [SE] Sweden ..... 9602355

[51] Int. Cl.[7] ..... B22D 27/20; C22C 21/04

[52] U.S. Cl. ..... 164/4.1; 164/57.1; 164/154.1; 420/552

[58] Field of Search ..... 164/4.1, 150.1, 164/154.1, 57.1; 148/549; 420/552; 75/377

[56] References Cited

U.S. PATENT DOCUMENTS

| | | | |
|---|---|---|---|
| 3,785,807 | 1/1974 | Backerud . | |
| 3,933,476 | 1/1976 | Chopra et al. . | |
| 4,298,408 | 11/1981 | Langdon et al. . | |
| 4,612,073 | 9/1986 | Guzowski et al. . | |
| 4,748,001 | 5/1988 | Banerji et al. . | |
| 4,812,290 | 3/1989 | Sigworth . | |
| 5,055,256 | 10/1991 | Sigworth et al. . | |
| 5,180,447 | 1/1993 | Sigworth et al. | 420/552 |

FOREIGN PATENT DOCUMENTS

| | | | |
|---|---|---|---|
| 6-269900 | 9/1994 | Japan | 164/4.1 |

OTHER PUBLICATIONS

"The Role of Boron in the Grain Refinement of Aluminum" M.M. Guzowski et al., Metallurgical Transactions, vol. 18A, 1987.

"Grain Refining Response Surfaces in Aluminum Alloys," W.C. Setzer et al., Light Metals, 1989.

"Studies of Dendrite Coherency in Solidifying Aluminum Alloy Melts by Rheological Measurements," Chai et al., 2nd International Conference on the Processing of Semi–Solid Alloys and Compounds, Cambridge, Mass., Jun. 9–12, 1992, pp. 193–201.

"Binary Phase Diagrams," Okamoto et al., vol. 1, ASM International, 1990.

"Study of the Mechanism of Grain Refinement of Aluminum After Additions of Ti–and B–Containing Master Alloys," Johnsson et al., Metallurgical Transactions, vol. 24A, Feb. 1993, pp. 481–491.

"Aluminum Alloys: Structure and Properties," Mondolfo, Butterworths (1976).

*Primary Examiner*—Kuang Y. Lin
*Attorney, Agent, or Firm*—Nixon & Vanderhye

[57] ABSTRACT

The invention is a method of controlling the grain refinement of certain aluminium alloys. The grain sizes for different values of the grain growth index, GGI, are determined for the used casting method. The GGI is represented by the sum of m(k–1) value multiplied with the concentration for every element in the aluminium alloy. If the value for a certain alloy is compared with known relations between the m(k–1) value and the grain size the composition of the alloy melt is amended to an optimum grain size by adding a grain size affecting agent. The method can be further improved by optimising the amount of nucleating agent.

12 Claims, 7 Drawing Sheets

Coherency point

METHOD FOR OPTIMIZATION OF THE GRAIN REFINEMENT OF ALUMINUM ALLOYS

A new method is disclosed to control the addition levels that will give optimum grain refinement in aluminium-based alloys. The method consists of first calculating the grain growth index for the composition of the alloy under consideration, and then determining how much additional grain size affecting agents, e.g. titanium and/or boron must be added to obtain desired results.

The procedure also makes it possible to e.g. determine the best titanium to boron ratio for grain refinement. Optionally, the method can be further improved by establishing the crystal coherency point. An algorithm or formula, is proposed to calculate the optimum refinement, and methods of grain refinement using this algorithm is also disclosed.

BACKGROUND

Primary grain size in material produced by a casting process depends on the nucleation frequency and on the growth rate of the first crystals formed during the solidification process. To control the grain size in order to obtain coarse grains, certain elements or compounds are avoided, while other such additives are made in order to obtain a fine grain size. However, when it concerns grain refinement, a quick and reliable method to measure and to control the properties as cast of a certain melt before casting has so far been missing. As a result the additives are often added in amounts that are much larger than what is necessary. Apart from the drawback of the unnecessary high costs of additives, these large additions often lead to problems with large agglomerated particles when recycling the material. Hence, there is a need for a method for obtaining castings comprising small nucleating particles which uses a minimum of grain-modifying additives.

As mentioned above, the addition of nucleating particles to stimulate the formation of crystals upon solidification is well-known. Examples of suitable nucleating particles are boride or carbide particles (aluminium), zirconium (magnesium) and TiC-particles (steel) etc. In many cases, it is also possible to control the growth parameter of crystals in solidifying metal melts.

As already mentioned, the present invention relates to optimising the grain refinement of aluminium alloys. It is based upon controlled additions of agents promoting grain refinement of aluminium, such as the elements Ti, Zr, B, N and C, mostly in the form of master alloys, which are added to the molten metal.

The master alloys are usually added in the form of small buttons or ingots, or when continuous additions are desirable (as in direct chill casting of billets or slabs) the addition is made by feeding a rod into the flowing melt stream. Various master alloy compositions and methods of manufacture and use have been proposed. (See, for example, patents U.S. Pat. Nos. 3,785,807, 3,933,476, 4,298,408, 4,612,073, 4,748,001, 4,812,290 and 5,055,256).

It should be stressed that all aluminium-titanium-boron (Al—Ti—B) master alloys, regardless of their composition, are a mixtures of two crystals interspersed in a matrix of solidified aluminium. These two phases are titanium diboride (Al,$TiB_2$) and titanium aluminide ($TiAl_3$). The whole range of boride particles from $AlB_2$–$TiB_2$ may form during production of master alloys.

In alloys with excess Ti compared to what is needed to form $TiB_2$ most boride particles have a composition close to $TiB_2$. For the sake of simplicity this phase is considered in the following text.

Virtually all of the titanium and boron in master alloy grain refiners are contained in these crystals, because the solubility of boron and titanium in solid aluminium at room temperature is very small. This means that changing the master alloy composition only changes the relative proportion of these two crystals which are added to affect the grain refinement.

In spite of this simple fact, there has been an enormous amount of controversy, and disagreement about what Ti to B ratio the master alloy should contain for best grain refinement. This question was considered at some length in U.S. Pat. No. 4,612,073 and also in the paper by M. M. Guzowski, G. K. Sigworth and D. A. Sentner entitled "The Role of Boron in the Grain Refinement of Aluminium" (published in *Metallurgical Transactions*, vol. 18A, 1987, on pages 603–610). The view taken by Guzowski et al. was that boron acts to change the shape of the $TiAl_3$ crystal and that $TiB_2$ can also be an effective nucleant when there is a significant amount of dissolved Ti in the melt. This question (of the optimum Ti/B ratio) has also been addressed in an empirical fashion, by doing extensive grain refining tests, and then using the measured results to "map out" desired grain refining practises. A typical example of this approach is the paper entitled "Grain Refining Response Surfaces in Aluminium Alloys", which as published by W. C. Setzer et al. on pages 745–748 of *Light Metals* (1989).

In spite of the importance of this question, there is no understanding of what the optimum titanium to boron ratio should be, for any particular alloy and for a specific casting process. Over the years, our empirical knowledge has led us to realise that the best grain refiner for one alloy may not be the best for another alloy. Commercial alloys range from relatively pure aluminium (such as foil and electrically conducting wire) to casting alloys which may contain nearly 20% of dissolved elements. It has been found that master alloys which grain refine well in pure aluminium do not usually work in highly alloyed melts, and vice versa. (See U.S. Pat. No. 5,055,256, where a master alloy composition has been disclosed solely for aluminium-base alloys containing high Si contents).

Several methods based on thermal analysis have been proposed to monitor the grain refining process (U.S. Pat. No. 3,785,807; Apelian et al., AFS Transactions, 84-161, p. 297–307). However, none of these methods can be generally applied, as one single temperature/time curve cannot separate the two phenomena of nucleation and growth as independent processes.

This situation means that in many cases the grain refiner practice used in the cast shop is far from the optimum procedure. At best, one is perhaps using too much grain refiner, and thereby spending too much for the master alloy. At worst, one can run into casting problems, such as cracking or other defects in the finished cast product.

OBJECTS OF THE INVENTION

One object of this invention is to present a detailed understanding of how the composition of the aluminium alloy affects its grain refinement. A further object of this invention is to disclose a method whereby the optimum grain refinement may be obtained. Toward this end an algorithm, or formula, is disclosed which may be used to calculate the desired refinement. A further object is an apparatus which calculates how much grain size affecting agents and nucleating agents that has to be added to a certain molten aluminium alloy in order to obtain optimum grain refinement.

Other objects may be discerned by those skilled in the art from subsequent descriptions of the invention, figures and examples.

SUMMARY OF THE INVENTION

This invention stems from the discovery that the grain refinement of various aluminium-based alloys follows a certain regular pattern, when the grain refinement is considered in a certain way. It relates to a method of controlling the grain refinement of certain aluminium alloys, comprising the steps of a) for the casting method used, calibrating the grain sizes for different values of the grain growth index GGI, as represented by the formula:

$$GGI=\Sigma m_i C_i(k_i-1)=m_1C_1(k_1-1)+m_2C_2(k_2-1)+...$$

where $m_i$ is the slope of the liquidus in the binary (Al-i) system, $C_i$ is the concentration of its dissolved solute in the alloy, and $k_i$ is the distribution coefficient of solute i between solid and liquid, and where $m_1$, $C_1$, $k_1$, etc. represents the corresponding values for each alloy constituent;

b) determining the GGI value for the particular aluminium base material by using the formula in a);

c) using the calibration data obtained in a) for calculating the grain size of the aluminium base material and how the concentration of grain size affecting agents in the aluminium melt should be changed in order to obtain an aluminium casting, having a desired crystal grain size; and d) adding the amount of grain size affecting agents calculated in c) to the melt.

Optionally the method can be further improved. It has been found that there exists a close relationship between grain size and the "dendrite coherency point" ($f_s$*) which can be used to optimise nucleation. The dendrite coherency point is the moment when a solid phase network is established throughout the entire volume of a casting, and from that moment phenomena like macrosegregation, shrinkage, porosities and hot tearing start to develop.

To establish the coherency point, the fraction solid is determined as function of the solidification rate ($df_s/dt$). This can either be done by a thermal analytical technique, as described in "Solidification Characteristics of Aluminium Alloys, Vol. 1, Wrought Alloys, (Bäckerud et al.,) Skanaluminium 1986, p. 65–70, or by measuring the viscosity as described by Chai et al., Proceedings of 2nd international conference on the processing of semi-solid alloys and compounds, Cambridge, Mass., Jun. 9–12 1992, Eds. S B Brown and M C Merton Flemmings, p. 193–201. However, the latter method involves a tedious measurement which is difficult to apply in a factory environment.

The above mentioned thermal analysis can be carried out by studying the temperature gradient between wall and centre in a small test casting during the solidification process. This gradient successively builds up during the initial stage of the solidification process and reaches a maximum at the coherency point, whereafter the gradient becomes lower. The time and fraction solid at the turning point of the gradient is determined e.g. by recording the first derivative of the curve representing the temperature difference between wall and centre.

Although the technique of measurement of dendrite coherency has been known previously, it has not been connected to the possibility of controlling grain size in metal castings.

The grain size affecting agents are preferably Ti and/or B. The amount of Ti that is to be added to aluminium melts, should result in a GGI value in refined alloy which corresponds to a grain size less than equal to the desired grain size ($GGI_d$). This may be calculated by the formula:

$$Amount_{Ti} = \frac{GGI_d - GGI_b}{(k_{Ti} - 1)m_{Ti}}$$

where $Amount_{Ti}$ is the percentage by weight of Ti to be added to the melt, $GGI_d$ is the grain growth index resulting in aluminium castings having a minimal grain size, $GGI_b$ is the grain growth index of the original aluminium base material, $m_{Ti}$ is the slope of the liquidus in the binary (Al—Ti) system, $k_{Ti}$ is the distribution coefficient of Ti between solid and liquid.

The calculations can also be made with ternary or multinary systems, which gives slightly different constants. The results are equivalent to the above binary calculations.

DETAILED DESCRIPTION OF THE INVENTION

Figure 1:
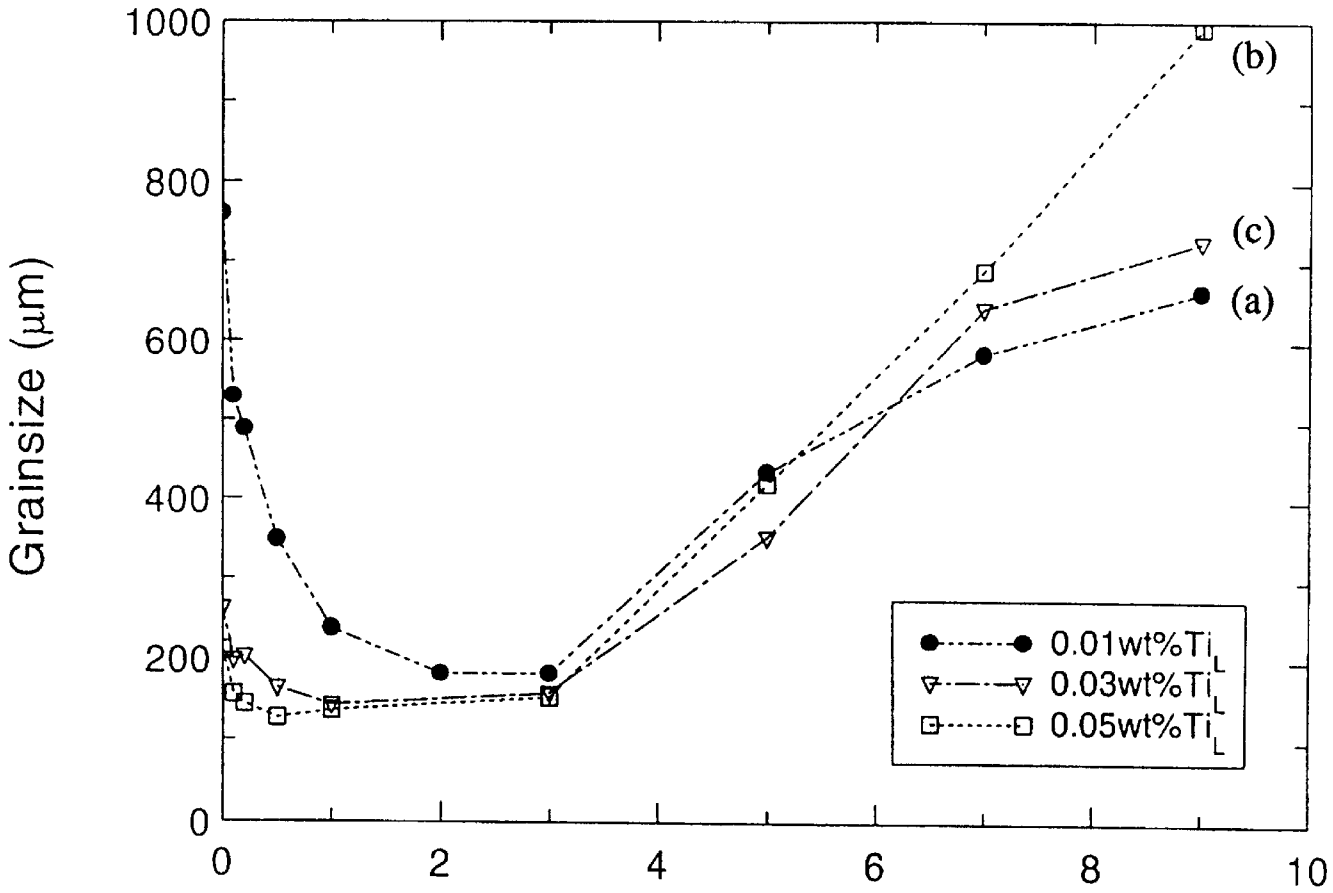
Figure 2:
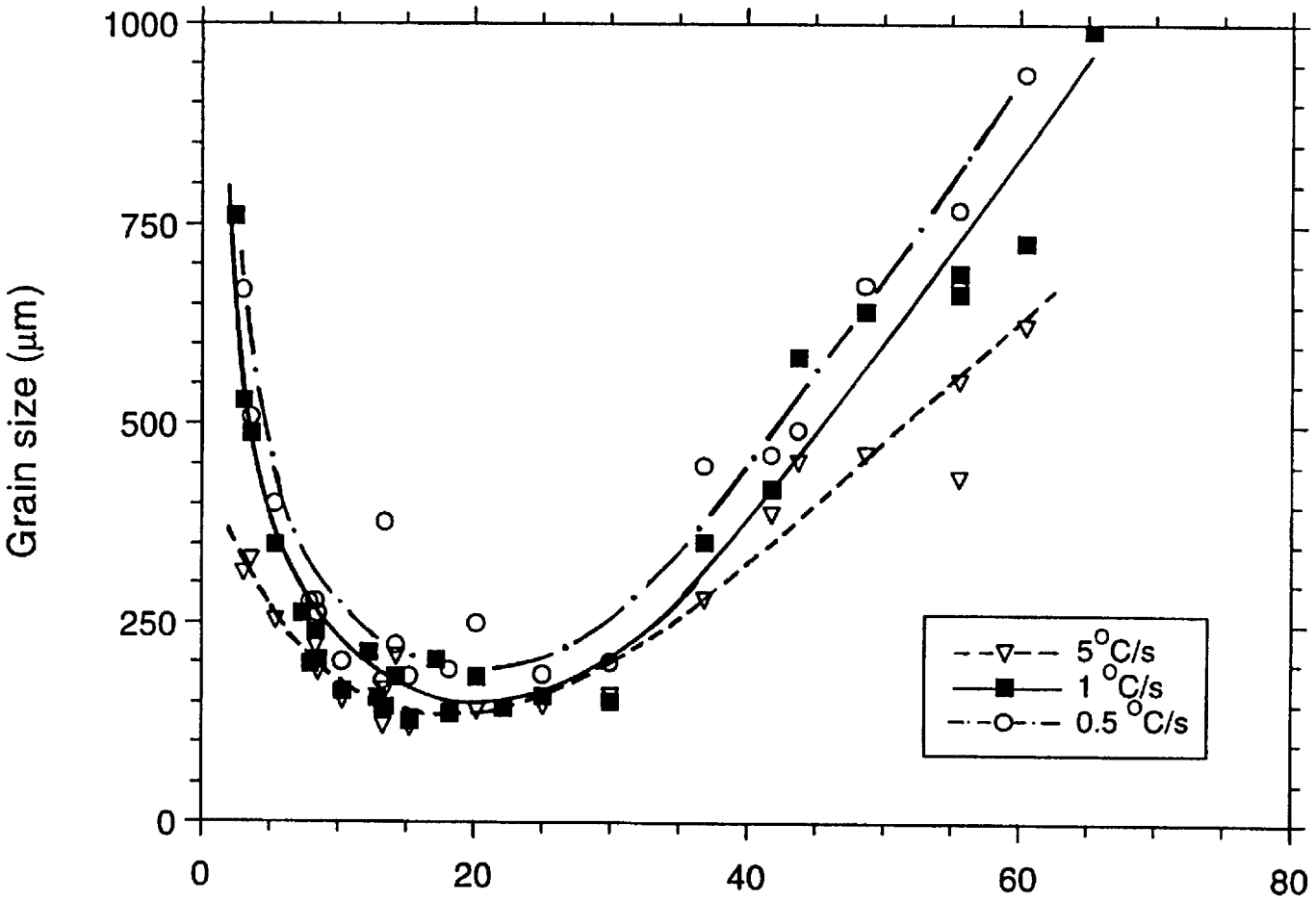
Figure 3:
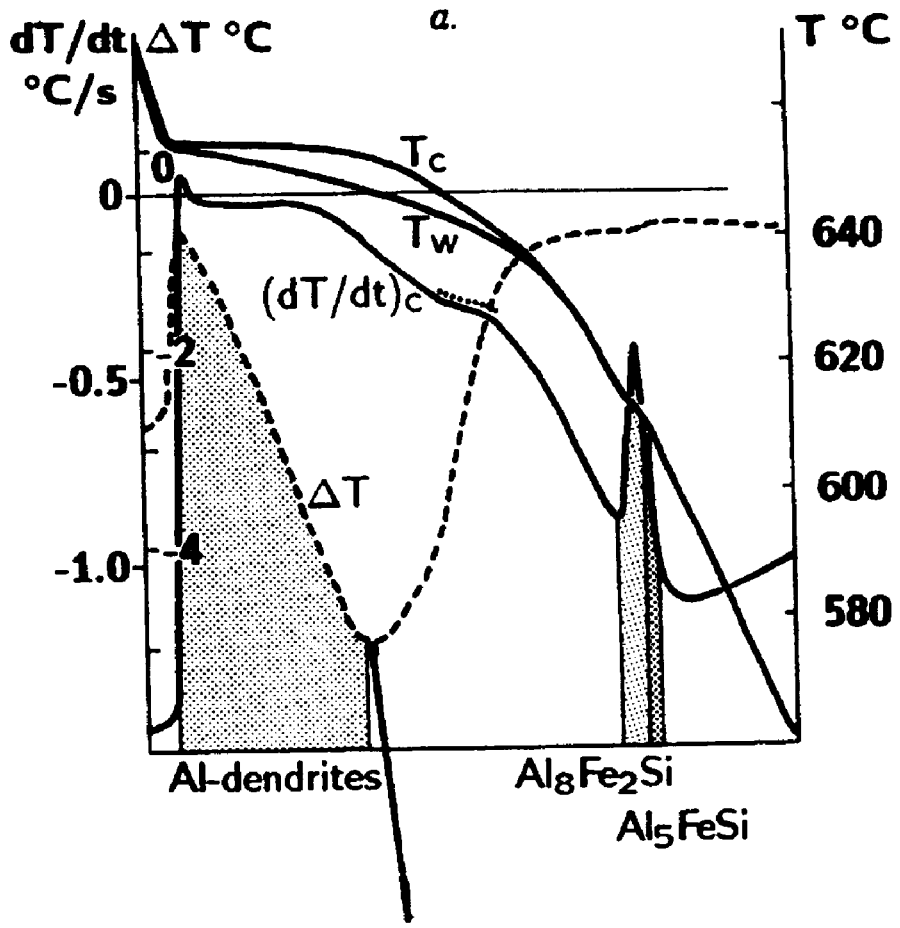
Figure 4:
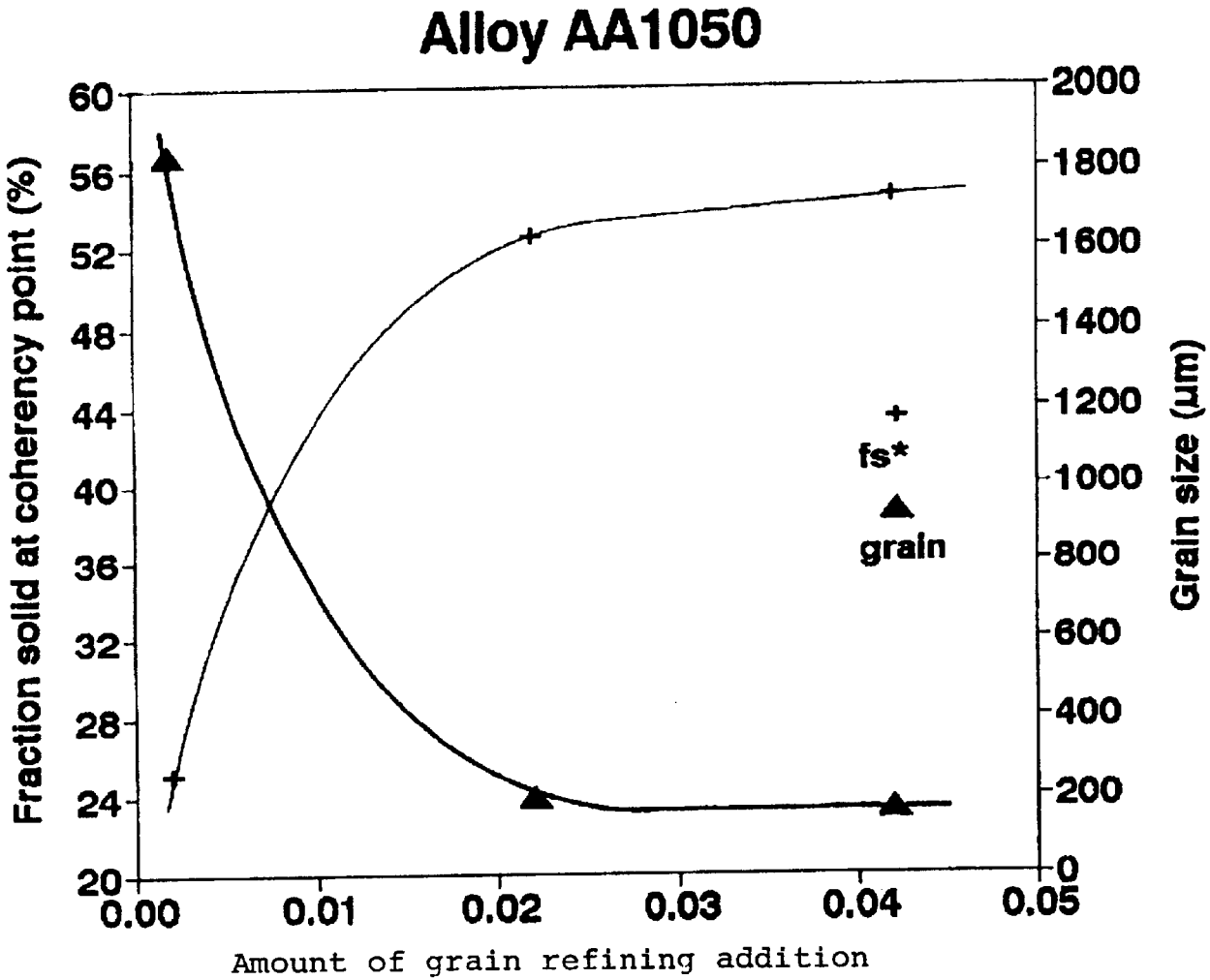
Figure 5:
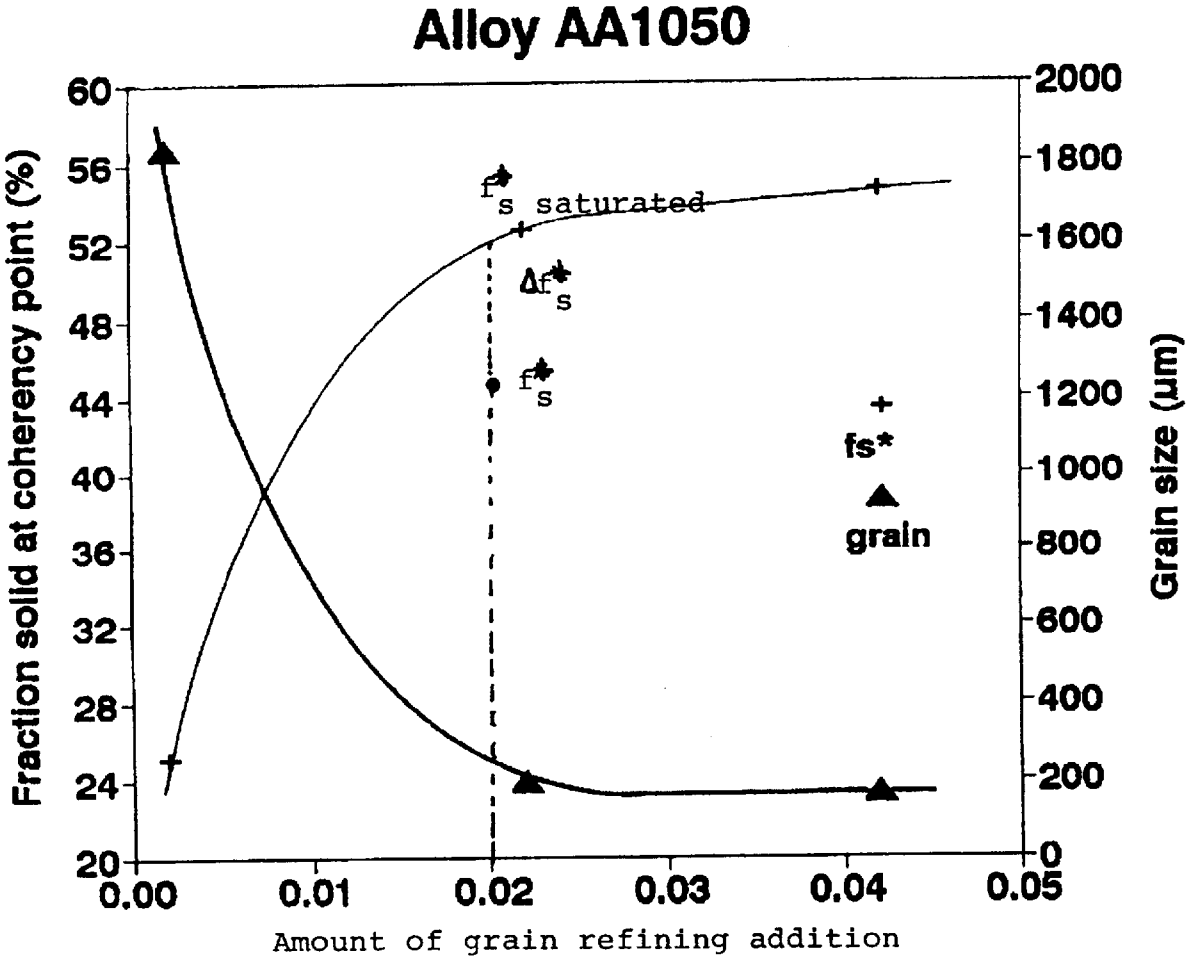
Figure 6:
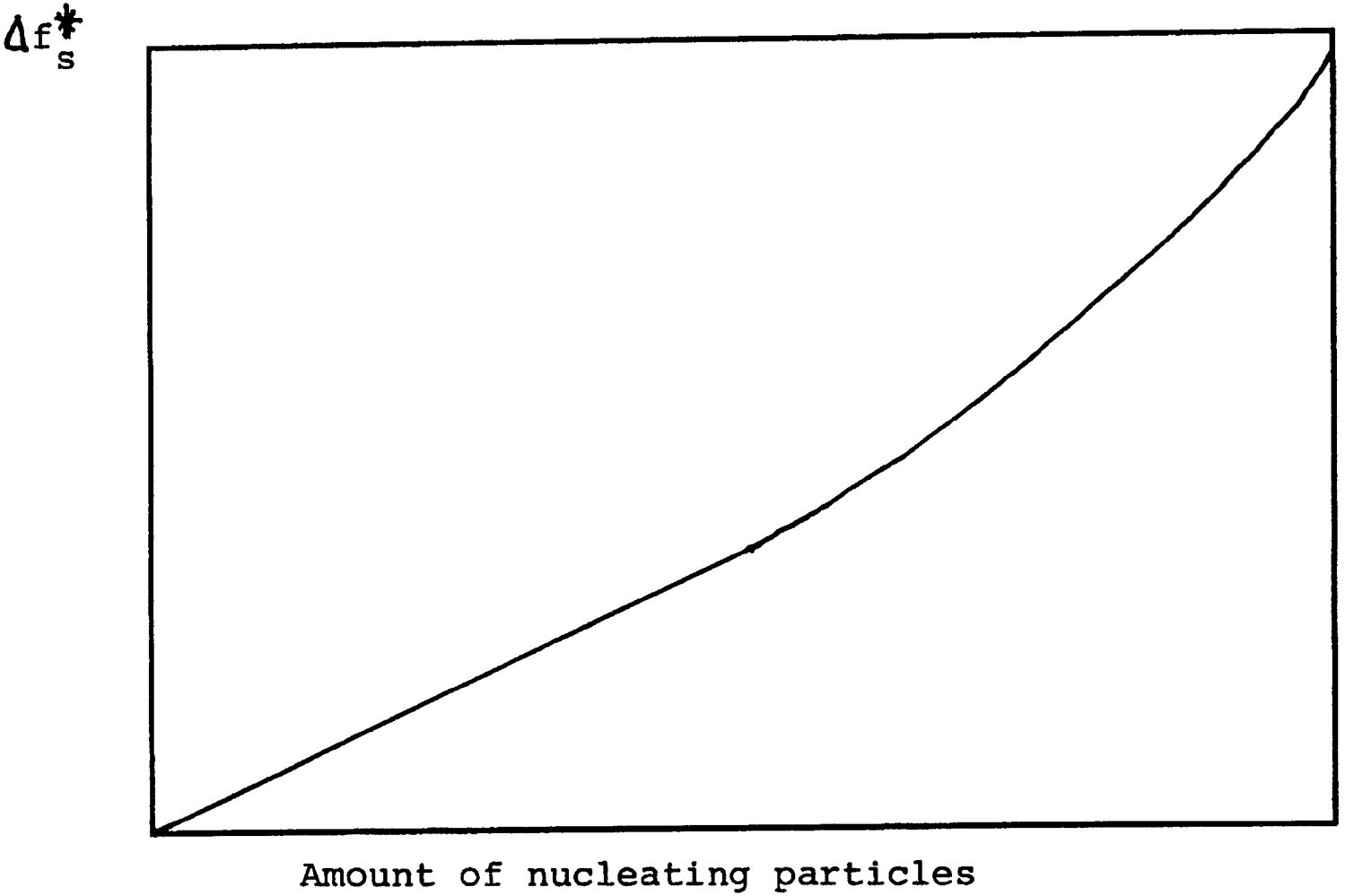
Figure 7:
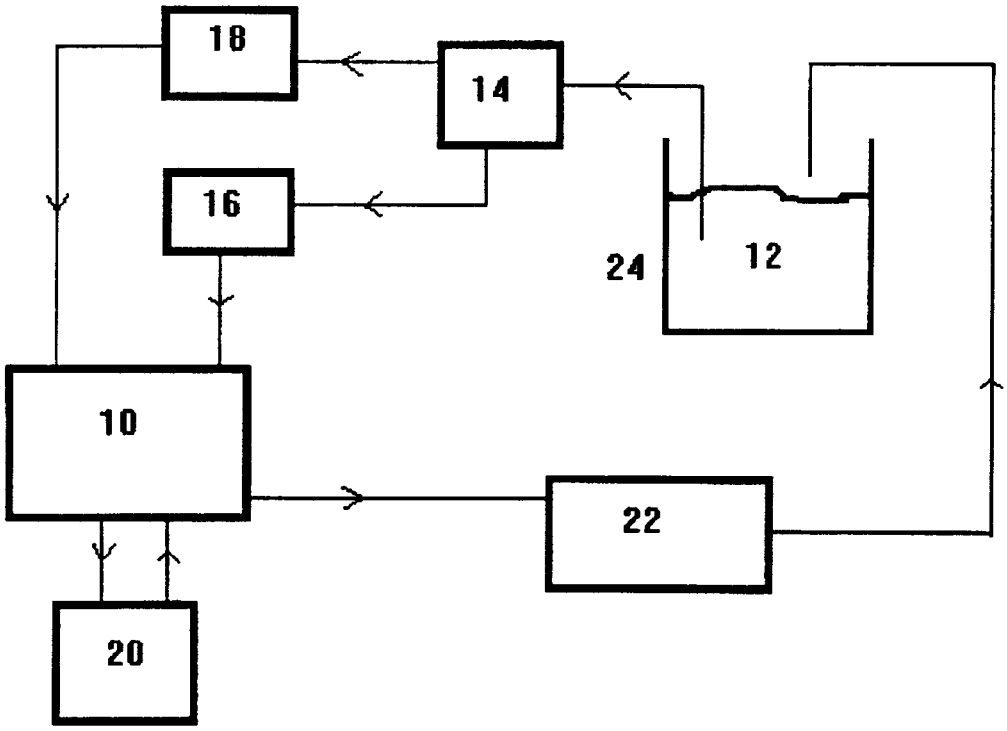

The invention will now be described with reference to the enclosed figures, in which:

FIG. 1 discloses a diagram showing the grain size of aluminium alloys as a function of their content of silicon and titanium;

FIG. 2 discloses a diagram showing the grain size of aluminium alloys as a function of the above defined grain growth index (GGI) for different cooling rates;

FIG. 3 shows thermal analysis data collected from centre and wall in samples of aluminium alloy AA 6063 during solidification at a cooling rate of ≈1° C./s. The minimum in the ΔT curve represents a sudden change in the temperature gradient between cetre and wall and corresponds to the coherency point. FIG. 3 was originally published in B äckerud et al., Solidification Characteristics of Aluminium Alloys, Volume 1: Wrought Alloys, Skanaluminium, Universitetsforlaget AS, Oslo 1986, page 67;

FIG. 4 relates to a diagram disclosing the fraction solid at the coherency point ($f_s$*) and the grain size, respectively, as functions of the amount of grain refining addition for the alloy AA 1050 in a solidifying melt containing a surplus of nucleating particles. The curve shown is therefore a saturation curve;

FIG. 5 discloses a diagram of the same type as FIG. 4 in which one step of the claimed method is demonstrated;

FIG. 6 shows $\Delta f_s$* as a function of the amount of nucleating particles that has to be added to the solidifying melt in order to obtain the saturation curve in FIG. 5; and FIG. 7 briefly outlines an apparatus for carrying out the method according to the present invention.

It is to be understood that the different alloy correlations demonstrated by the curves in the figures have to be calibrated for each sampling and casting technique employed.

We first consider the addition of an Al—5%Ti—1%B alloy. From the stoichiometry of the $TiB_2$ phase and molecular weights of the two elements, we find that there is 2.2 wt. % Ti in this master alloy that is tied up in the boride compound This is important, because the boride is essentially insoluble in aluminium, which means that this titanium is not "free" to dissolve in the alloy. The remaining titanium (5.0%−2.2%=2.8%) is present in the form of soluble titanium and titanium aluminide ($TiAl_3$) crystals, which readily dissolve in molten aluminium.

Experiments were made in which a fixed amount of free titanium (0.01% dissolved Ti added in the form of an Al—5%Ti—1%B master alloy) was added to a number of molten aluminium alloys. One series of experiments was made in aluminium melts containing various amounts of dissolved silicon. A small casting was made from each of these melts. A thermocouple placed in the mold revealed that the cooling rate just prior to solidification was 1 degree C per second. The solid casting was cut in half, polished on the cut face, and etched to reveal the grain structure. The average grain size was then determined by the line intercept method. The grain size in micrometers (1000 micrometers=1 millimeter) in the silicon-containing alloys is shown versus composition in curve (a) of FIG. 1. It can be seen that a minimum is obtained at about three weight percent silicon.

A second series of similar experiments was made at a higher addition level (0.05% Ti), giving the results shown in curve (b) of FIG. 1. The grain size is much smaller at lower silicon contents; showing a minimum at about 0.5% Si; and larger in alloys containing more than about 5% Si.

A third set of experiments were made at an intermediate addition level (0.03%Ti), and gave results intermediate to the first two, as shown by curve (c) of FIG. 1. It is interesting to note that there is a cross-over point at the minimum of the curves.

Another series of experiments were made in a series of Al—Si—Fe—Ti melts, and also in some commercial alloys containing various amounts of dissolved impurities. The inventors have discovered that the results presented in FIG. 1, and the results of all complex alloys (with one exception noted below) can be combined into a single curve by the use of a combined grain growth index. The basis for this index is described below.

The composition (in the aforementioned examples, %Si and %Ti) of the base alloy influences the growth rate of the grains. At first, as we add an element to relatively pure aluminium, the growth of grains is slowed. This is because in alloyed melts the diffusion of a solute element must occur ahead of growing solid phase. This diffusion process restricts and slows the growth of new crystals, and appears to allow borides to become active nuclei. I. Maxwell and A. Hellawell (in the article "A Simple Model for Grain Refinement During Solidification", published on pp. 229237 of *Acta Metallurgica*, Vol. 23, 1975) have suggested on theoretical grounds that the rate of crystal grain growth is inversely proportional to the product mC(k−1), where m is the slope of the liquidus in the binary system (Al—Ti), C is the concentration of dissolved titanium in the alloy, and k is the distribution coefficient of solute between solid and liquid titanium.

This grain growth index has been proposed on theoretical grounds, but its importance in understanding and controlling the grain refinement of aluminium has not been fully realized heretofore. The earlier study of Maxwell and Hellawell only studied relatively pure aluminium. It was not realized that slowing of the grain growth process continues until a minimum grain size is attained. Nor was it realized that at higher addition levels, the growth rate increases once again. (This is presumably because a new mechanism of grain growth begins to become important.)

And finally, and perhaps most importantly, the inventors have discovered that the effect of each solute element in aluminium is additive. In other words, the grain growth index for a multicomponent alloys is the algebraic sum of that for each individual element. This combined index is represented mathematically by:

$$\Sigma m_i C_i(k_i-1)=m_1C_1(k_1-1)+m_2C_2(k_1-1)+m_3C_3(k_3-1)+...$$

The values of m and C for a number of alloying elements commonly found in aluminium are given below in Table I. From these values, and from simple calculations, one finds that an addition of 0.10% Ti is equivalent to about 4%Si, as far as the grain growth index is concerned. Thus, even small additions of Ti have a large effect on grain growth.

TABLE I

| Element | k | m | (k − l)m | Maximum concentration, weight-% |
|---|---|---|---|---|
| Ti | >>9 | 30.7 | 245 | 0.15 |
| Ta | 2.5 | 70 | 105 | 0.10 |
| V | 4.0 | 10 | 30 | >>0.1 |
| Hf | 2.4 | 8.0 | 11.2 | >>0.5 |
| Mo | 2.5 | 5 | 7.5 | >>0.1 |
| Zr | 2.5 | 4.5 | 6.8 | 0.11 |
| Nb | 1.5 | 13.3 | 6.6 | >>0.15 |
| Si | 0.11 | −6.6 | 5.9 | >>12.6 |
| Cr | 2 | 3.5 | 3.5 | >>0.4 |
| Ni | 0.007 | −3.3 | 3.3 | >>6 |
| Mg | 0.51 | −6.2 | 3 | >>34 |
| Fe | 0.02 | −3 | 2.9 | >>1.8 |
| Cu | 0.17 | −3.4 | 2.8 | 33.2 |
| Mn | 0.94 | −1.6 | 0.1 | 1.9 |
| Zn | 0.4 | −1.6 | 0.96 | >>50 |

(The above figures are compiled from T. B. Massalski: "Binary phase diagrams" Vol 1 ASM International (1990); M. Johnsson, L. Bäckerud, and G. K. Sigworth: Metall. Trans. 24A (1993) pp. 481–491; and L. F. Mondolfo: "Aluminium Alloys: Structure and Properties", Butterworth & Co. (1976)).

From the theoretical and experimental studies in relatively pure aluminium, we find that the growth rate of solid grains during solidification is proportional to 1/ΣmC(k−1). The grain size is proportional to the growth rate. When the grain size of aluminium based alloys are plotted versus the combined grain growth index, 1/ΣmC(k−1), one finds that all alloys which solidify at the same rate fall on the same curve. The results shown before in FIG. 1, are replotted in FIG. 2 together with the results of other tests made in multicomponent alloys. Data for two other cooling rates are also given in FIG. 2.

The tests accomplished to date, show that the curves shown in FIG. 2 can be used to predict the grain refining ability of Al—Ti—B additions in all aluminium base alloys, with one notable exception. It has been found that, in alloys which have substantial amounts of Zr, there is a precipitation of a titanium-zirconium aluminide. This precipitate removes dissolved Ti and Zr from the melt, so that the grain size is much larger than expected (as calculated from the base alloy composition and the grain growth index). Thus, Zr can "poison" the effect of Ti. Hence, an extra amount of Ti has to be added to an alloy comprising Zr, in order to compensate for this poisouous effect of Zr.

When applying the method of the present invention in a foundry, it is often practical to start by taking a sample of the molten metal. The sample is then allowed to solidify and its grain size is measured, preferably by using ultrasound. In this case, it is only necessary to carry out the present invention when the grain size of the sample differs unfavourably from a desired grain size.

EXAMPLES OF APPLICATION OF THE INVENTION

To fix the concepts described above firmly in mind, and to clearly understand how they are to be applied in practice, it will be useful to consider some concrete examples of how this technology can be used in the cast shop.

Example 1

We first consider the solidfication of a 1100 alloy. This alloy is relatively pure, and it is often used to produce ingots which are rolled into foil. A sample of molten alloy is taken from the furnace prior to casting, and the analysis is found to be:

Si 0.6% Fe—0.3% Cu—0.05% Mn—0.01% Zn—0.06% Ti—0.005%

From the above compositions and the values given in Table I, we can calculate the grain growth index for the alloy. To aid in visualization of how this is done, the calculations are tabulated below:

| element | C | m(k − l) | mC(k − l) |
|---|---|---|---|
| Si | 0.60 | 5.9 | 3.54 |
| Fe | 0.30 | 2.9 | 0.87 |
| Cu | 0.05 | 2.8 | 0.14 |
| Mn | 0.01 | 0.1 | 0.001 |
| Zn | 0.06 | 0.96 | 0.058 |
| Ti | 0.005 | 245 | 1.225 |
| total | — | — | >>5.8 |

This alloy will be cast into a large slab, whose cooling rate is 1° C./sec, and from past experience it is known that the grain size must be less than or equal to 300 microns for good results. From FIG. 2 we find that the desired grain growth index must be greater than about 10. This means we must increase the "free" titanium content, by adding grain refiner, by an amount equal to:

$$(10-5.8)/245=0.017\%\ \text{Ti}$$

This addition can be accomplished in a number of ways, but is generally desirable to do the grain refinement with as little boron as possible. High boron additions can cause pin holes in foil, because the boride particles are insoluble and wind up in the final product. One possibility would be to add Al—10Ti waffle in the furnace. Another possibility is to add Al—6Ti rods to the launder of the furnace.

The above calculated Ti content (0.017%) represents the minimum desired content of "free" Ti. The maximum permissable value is found by considering the right-hand portion of the curves shown in FIG. 2. We find that the grain growth index must be less than about 36. Thus, the maximum Ti content allowed is $$(36-5.8)/245=0.123\%\text{Ti}$$

This is important, because at the surface of undissolved aluminides ($TiAl_3$ particles) the titanium content will be about 0.1 5%Ti, greater than the permissible maximum value. This high titanium content at the surface of "duplex" particles was noted before by Guzowski et al. (U.S. Pat. No. 4,612,073 and their aforementioned article), but this mechanism would not appear to be suitable for this case.

Thus, the best grain refining practice for this alloy is to make an addition of about 0.02%Ti, in a form which dissolves readily into the metal. A fast dissolving rod is suitable for launder additions. We also need to add a certain amount of boron, because the borides act as nucleants in this alloy. Commercial experience suggests that an addition level of about 20 ppm of boron (or 65 ppm or boride) would be suitable. This could e.g. be added as Al—3%Ti—1%B or Al—5%Ti—1%B rod.

It can be seen that the optimum grain refining practice for this alloy is obtained by making two separate additions. This is easily accomplished by feeding rods of two different alloys into the launder. The two rods may be fed by use of two rod feeders; or by use of a single rod feeder which can handle two rods (fed at different speeds). In either case, the addition rates (and rod feeding rates) will be controlled by a computational algorithm, which contains the calculations and logic described in the above example. The grain size affecting agent and nucleating agent are added as a master alloy, a tube containing granules and/or particles, or as a wire.

Example 2

We now consider the solidification of a 3005 alloy, which has the following chemistry:

Si—0.6% Fe—0.7% Cu—0.25% Mn—1.25% Mg—0.45% Zn—0.15% Ti—0.05

The grain growth index for this alloy is calculated below:

| element | C | m(k − l) | mC(k − l) |
|---|---|---|---|
| Si | 0.60 | 5.9 | 3.54 |
| Fe | 0.70 | 2.9 | 2.03 |
| Cu | 0.25 | 2.8 | 0.70 |
| Mn | 1.25 | 0.1 | 0.125 |
| Mg | 0.45 | 0.1 | 0.045 |
| Zn | 0.15 | 0.96 | 0.144 |
| Ti | 0.05 | 245 | 12.28 |
| total | — | — | >>18.8 |

An examination of FIG. 2 shows that the grain growth index is very nearly at the optimum value, and will give a grain size of about 150 microns at a cooling rate of 1° C./sec. In this case only a small addition of boride including particles without excess titanium is needed.

Example 3

This example is the same as Example 2, except the titanium content is very near the maximum allowed in this alloy: 0.09%Ti. The grain growth index therefore increases to 28.64. The grain size would also increase, to about 200 microns. This is also a reasonably small value, and so in this case also it is probably acceptable merely to make a small addition of boride-containing master alloy. It would be possible, however, to improve the performance by adding an amount of Al—B master alloy, which would react with the dissolved Ti to form borides, and thereby remove some of the "free" Ti. A similar result could also be obtained with a master alloy containing borides which are a mixture of $TiB_2$ and $AlB_2$. (Such a material is disclosed in U.S. Pat. No. 5.055,256).

In this case an overstoichiometric master alloy of the type AlZrB, could be used to the advantage of a) supplying nucleating particles of $ZrB_2$ and b) simultaneously reducing the constitutional effect of Ti as described above. It is also possible to use niobium.

Example 4

This example describes how optimum grain refinement of an aluminium alloy can be obtained by adding $TiB_2$-particles (nucleants) and elemental titanium (growth restricting element).

It is common practice to add boride particles as well as elemental titanium in the form of a master alloy containing the particles and an excess of titanium in a fixed ratio. A whole series of such master alloys are available on the market with varying Ti/B ratio. The most widely used master alloy contains 5% Ti and 1% B. It is not certain, however, that the alloy used optimizes the grain refining action, i.e. uses the minimum amount of hard boride particles in combination with the excess of elemental titanium needed. In an optimized process, therefore the following steps are taken:

Step 1: Based upon a chemical analysis (in practice performed by a spectrometer) of the base melt and according to the principles disclosed in exampels 1–3, GGI (i.e. $\tau c_i m_i(k_i-1)$) is calculated and noted in a diagram as shown in FIG. 2. The proper amount of titanium in liquid solution ($\Delta Ti_l$) is added to a sample of the base melt to achieve minimum grain size.

Step 2: A thermal analysis is performed on the so treated sample volume, and the coherency point $f_s^*$ is determined.

Step 3: Using the diagram in FIG. 4, the corresponding $f_s^*{}_{saturated}$ is calculated for the GGI value determined in step 1 (In FIG. 4 the expression "amount of grain refining addition" is used instead of GGI. This amount is propotional to GGI if only one component, e.g. titanium, is variable.). Then, $\Delta f_s^* = f_s^*{}_{saturated} - f_s^*$ is determined. A $\Delta f_s^*$ larger than 0 indicates a lack of nucleating particles and this deficiency has to be compensated by an addition of suitable particles. The amount to be added can be calculated by using the calibration curve in FIG. 6. FIG. 5 shows more in detail how to determine $\Delta f_s^*$.

Step 1 defines the inherent crystallization properties of the melt. Step 2 adjusts the growth parameter to optimize the growth conditions so that it is possible to obtain a minimum grain size. Step 3 indicates whether there is a deficiency of nucleating particles restricting the number of crystals formed. If there are enough or a surplus of nucleating particles present, the $f_s^*$ will attain its maximum saturation value (for this alloy and casting method>52%) according to the curve presented in FIG. 5.

Example 5

The present method for controlling grain refinement can also be automatized. An example of an apparatus for carrying out the present invention is disclosed in FIG. 7.

A batch (24) contains molten aluminium base material (12) whose grain size is to be minimized. A sampling device (14) takes a sample of the base material (12) and delivers it to a chemical analysing device (16). Optionally the sampling device (14) also delivers a sample to a coherency point determining device (18). The chemical analysing device (16) and (if present) the coherency point determining device (18) send information to a computer device (10). By using stored data in a memory means (20), the computer device (10) then establish how much grain size affecting agents ($V_a$) and, optionally, nucleating agents ($V_b$) that has to be administrated to the melt and sends signals to a means (22) for administrating these agents so that the desired amounts are added to the melt.

We claim:

1. A method of controlling the grain refinement of aluminium alloys, comprising the steps of:

a) for the casting method used, establishing the grain sizes for different values of the grain growth index GGI, as represented by the formula:

$$GGI=\Sigma m_i C_i(k_i-1)=m_1C_1(k_1-1)+m_2C_2(k_2-1)+...$$

where $m_i$ is the slope of the liquidus in the binary (Al-i) system, $C_i$ is the concentration of its dissolved solute in the alloy, and $k_i$ is the distribution coefficient of solute i between solid and liquid, and where $m_1$, $C_1$, $k_1$, etc. represents the corresponding values for each alloy constituent;

b) determining the GGI value for the particular aluminium base material by using the formula in a);

c) using the data obtained in a) for calculating the grain size of the aluminium base material and how the concentration of grain size affecting agents in the aluminium melt should be changed in order to obtain an aluminium casting having a desired crystal grain size;

d) adding the amount of grain size affecting agents calculated in c) to the melt; and e) optionally adding an amount of nucleating agents required.

2. A method according to claim 1, wherein the grain size affecting agent is Ti and/or B.

3. A method according to claim 2, wherein the grain size affecting agent is Ti.

4. A method according to claim 3, wherein the amount of free Ti that is to be added to aluminium melts, having a GGI value lower than the GGI value resulting in aluminium castings having a minimum gram size, in order to obtain an aluminium casting having a desired grain size, is calculated by using the formula:

$$Amount_{Ti} = \frac{GGI_d - GGI_b}{(k_{Ti} - 1)m_{Ti}}$$

where $Amount_{Ti}$ is the percentage by weight of Ti to be added to the melt, $GGI_d$ is the grain growth index resulting in aluminium castings having a desired grain size, $GGI_b$ is the grain growth index of the original aluminium base material, mTi is the slope of the liquidus in the binary (Al—Ti) system and $k_{Ti}$ is the distribution coefficient of Ti between solid and liquid.

5. A method according to claim 1, wherein boron is added to the melt to remove excess titanium if the base grain growth index is greater than the desired grain growth index.

6. A method according to claim 1, wherein titanium boride ($TiB_2$), aluminium boride ($AlB_2$) or any intermediate compositions($(Al,Ti)B_2$) and/or titanium carbide (TiC) is used as nucleant.

7. A method according to claim 1, wherein the grain size affecting agent and/or nucleating agent is added as a master alloy.

8. A method according to claim 7, wherein the grain size affecting agent and/or nucleating agent is added as a master alloy in a shape of a tube or a wire.

9. A process for producing a n aluminum alloy casting in which the grain refinement has been optimized, comprising the steps of:

allowing a sample taken from a certain molten aluminum alloy to be solidified; determining the grain size;

calculating and adding an amount of grain size affecting agents and/or nucleating agents to the aluminum alloy by the method according to claim 15, if the grain size of the sample differs from a desired grain size; and casting the molten aluminum alloy in a manner known per se.

10. A process according to claim 9, wherein the grain size is measured by using ultrasound.

11. A measuring system for controlling, in real time, the grain refinement of aluminium alloys; said measuring system comprising:

a sampling device (14) for taking a sample from a molten aluminium base material (12);

a chemical analyzing device (16) for determining the chemical composition of the base material (12);

equipment for determining grain size;

a computer device (10) for determining an amount value (Va) of a grain size affecting agent and an amount value ($V_b$) of a nucleating agent;

a memory means (20) which is provided with prerecorded values of 1) the slope of the liquidus in the binary (Al-i) system;
2) the distribution coefficient between solid and liquid; for a particular alloy constituent i, and
3) data representing the grain sizes for different values of the grain growth index GGI, as represented by the formula:

$$GGI=\Sigma m_i C_i(k_i-1)=m_1C_1(k_1-1)+m_2C_2(k_2-1)+...$$

where $m_i$ is the slope of the liquidus in the binary (Al-i) system, $C_i$ is the concentration of its dissolved solute in the alloy, and $k_i$ is the distribution coefficient of solute i between solid and liquid, and where $m_1$, $C_1$, $k_1$, etc. represents the corresponding values for each alloy constituent;

means (22) for administering grain size affecting agent and nucleating agent to a melt (12) using data from the chemical analysing device and the memory means; the computer being arranged to establish an amount value ($V_a$) of a grain size affecting agent to be added to the melt in response to data from the chemical analyzing device (14);

the computer controlling said means for administering nucleating agent to the melt so that the desired amount value ($V_b$) is added to the melt; said computer controlling said means for administering grain size affecting agent and nucleating agent to the melt so that the desired amount values ($V_a$, $V_b$) are added to the melt.

12. A measuring system for controlling, in real time, the grain refinement of aluminium alloys; said measuring system comprising:

a sampling device for taking a sample from a molten aluminium base material;

a chemical analyzing device for determining the chemical composition of the base material;

a device for determining grain size;

a computer device for determining an amount value (Va) of a grain size affecting agent and an amount value ($V_b$) of a nucleating agent to be added to a melt in response to data from said chemical analyzing device; said computer controlling said device for administering nucleating agent to the melt so that the desired amount value ($V_b$) is added to the melt;

a memory device provided with prerecorded values of 1) the slope of the liquidus in the binary (Al-i) system;
2) the distribution coefficient between solid and liquid; for a particular alloy constituent i, and
3) data representing the grain sizes for different values of the grain growth index GGI, as represented by the formula:

$$GGI=\Sigma m_i C_i(k_i-1)=m_1C_1(k_1-1)+m_2C_2(k_2-1)+...$$

where $m_i$ is the slope of the liquidus in the binary (Al-i) system, $C_i$ is the concentration of its dissolved solute in the alloy, and $k_i$ is the distribution coefficient of solute i between solid and liquid, and where $m_1$, $C_1$, $k_1$, etc. represents the corresponding values for each alloy constituent;

a device for administering grain size affecting agent and nucleating agent to a melt using data from said chemical analyzing device and said memory device;

said computer controlling said device for administering grain size affecting agent and nucleating agent to the melt so that the desired amount values ($V_a$, $V_b$) are added to the melt.

* * * * *

UNITED STATES PATENT AND TRADEMARK OFFICE

CERTIFICATE OF CORRECTION

PATENT NO. : 6,073,677
DATED : June 13, 2000
INVENTOR(S) : Backerud et al.

It is certified that error appears in the above-identified patent and that said Letters Patent is hereby corrected as shown below:

Column 10,
Line 24, delete “gram” and replace by -- grain --.

Signed and Sealed this

Twenty-fourth Day of May, 2005

JON W. DUDAS
*Director of the United States Patent and Trademark Office*